United States Patent [19]

Herrington et al.

[11] Patent Number: 4,512,296

[45] Date of Patent: Apr. 23, 1985

[54] DISTRIBUTOR MOISTURE GUARD

[76] Inventors: Allen G. Herrington, P.O. Box 93, Lynnwood, Wash. 98036; Nicholas L. Herrington, 14600 51st Ave. NE. #46, Marysville, Wash. 98270

[21] Appl. No.: 617,040

[22] Filed: Jun. 4, 1984

[51] Int. Cl.[3] ..... F02P 1/00

[52] U.S. Cl. ..... 123/146.5 R; 123/376; 123/146.5 A; 339/217 S; 200/19 DC

[58] Field of Search ..... 123/146.5 R, 376, 146.5 A, 123/146.5 C, 198 D, 198 E, 633; 200/19 DC; 339/217 S

[56] References Cited

U.S. PATENT DOCUMENTS

| | | | |
|---|---|---|---|
| 2,207,368 | 7/1940 | Arthur | 123/146.5 |
| 2,381,131 | 8/1945 | Mallory | 123/376 |
| 2,415,510 | 2/1947 | Mallory | 123/146.5 |
| 2,660,656 | 11/1955 | Wilkie | 123/146.5 |
| 2,798,109 | 7/1957 | Voigt | 123/146.5 |
| 3,441,690 | 4/1969 | Tibbs | 123/146.5 |
| 3,632,965 | 1/1972 | Guth et al. | 123/146.5 |
| 4,281,627 | 8/1981 | Sakurai | 123/146.5 A |
| 4,282,836 | 8/1981 | Fox et al. | 123/146.5 A |
| 4,302,638 | 11/1981 | Fox et al. | 123/146.5 A |
| 4,306,125 | 12/1981 | Fox et al. | 123/146.5 A |
| 4,348,993 | 9/1982 | Urno et al. | 123/146.5 A |
| 4,349,007 | 9/1982 | Onishi et al. | 123/146.5 A |

*Primary Examiner*—Raymond A. Nelli

*Attorney, Agent, or Firm*—Christensen, O'Connor, Johnson & Kindness

[57] ABSTRACT

A system for removing moisture and gases from the interior of a distributor. A moisture guard body (10) having an internal chamber (11) is connected in fluid communication with the interior of a distributor (30) and, through a selectively operable check valve (20) to the engine air intake means, such as to a spark arrester (40). During operation of the engine, both the cap (32) of the distributor and the moisture guard body are heated by the engine. When the engine ceases operation, the moisture guard body retains heat, cooling more slowly than the distributor cap. Moisture within the interior of the distributor is drawn into the warmer interior chamber (11), condensing there. Upon subsequent engine operation, a predetermined rate of flow of air through the spark arrester creates a low pressure which opens the check valve (20), providing a fluid path for evacuating the collected moisture and gases from the distributor.

14 Claims, 4 Drawing Figures

DISTRIBUTOR MOISTURE GUARD

BACKGROUND OF THE INVENTION

The present invention relates to ignition distributors for internal combustion engines and, more particularly, to a system which removes moisture and harmful gases from inside of the distributor and guards against the reformation of moisture therein.

The collection of moisture inside the distributor is a recurring and longstanding problem that has been associated with many distributor malfunctions. The source of this moisture is humid air, which is introduced into the interior of the distributor and condensed. For automotive engines, the problem often manifests itself during rainy periods or under conditions of high relative humidity. For marine engines, the highly moisture-laden operating environment inescapably makes distributor moisture a major cause of ignition difficulties.

During operation of the engine, the distributor is heated above the temperature of the surrounding air by the heat of the engine. When operation is ceased, the engine and distributor gradually cool down. During this cool-down period, the warm air inside the distributor draws in the cooler, humid outside air and traps it within the relatively small volume inside the distributor. Upon further cooling, moisture within the trapped humid air condenses on the distributor and on the electrical components contained therein. Moisture that has condensed on the inside surface of the distributor cap renders this surface conductive and, accordingly, shorts out the current intended for the cylinder spark plugs. Under these conditions, the engine simply does not start. A film of moisture on the inside surface of the cap may likewise cause a misfire between cylinder contacts, leaving carbon trails inside of the cap. Ultimately, this condition will cause the "burn-out" or failure of the distributor cap with abnormally low hours of use.

Moisture within the distributor also adversely affects the contained electrical components. When operated under such moist conditions, the ignition points develop a black, filmy deposit which interrupts the flow of electrical current. Moisture-caused carbon trails will also result in failure of the distributor rotor. After a period of time, the metal components of the distributor will rust because of moist conditions. The most important of these parts is the mechanical advance mechanism. When the centrifugal advance weights rust and become frozen, the engine loses power and exhibits only poor fuel economy. Finally, moisture-related difficulties within the distributor can cause failure of the ignition coil. Any of the above-described misfires in the distributor will demand more power from the coil. In a short period of time, this high demand will result in failure of the coil.

When a large amount of moisture is present, it will tend to condense and collect in the lower body of the distributor. Upon operation of the engine, this moisture rises into the cap, causing shorts that are manifested as rough engine operation or loss of ignition after only a short period of time.

As is well known, the sparking that occurs within the distributor causes the formation of various gases, such as oxides of nitrogen and ozone, that must be removed. Providing vents in the distributor cap or body is now the commercially accepted means for releasing the gases formed inside the distributor to the outside air. While providing this necessary function, the vents unfortunately provide the paths through which cool, moist air is drawn into the distributor as the engine cools down. In most marine applications, nonvented distributor caps are used in an effort to alleviate the problem of distributor moisture. However, since the lower housings of the distributors remain vented to release the formed gases, the moisture problem persists.

A number of proposals have been made to lessen the adverse affects of moisture and/or gases within a distributor. The following patents exemplify these proposals. U.S. Pat. Nos. 2,207,368 to Arthur; 2,415,510 to Mallory; 2,660,656 to Wilkie; 2,798,109 to Voigt; 3,441,690 to Tibbs; and 3,632,965 to Guth et al. The patents to Wilkie and Guth et al. describe two arrangements in which the control of moisture within a distributor is sought to be corrected by heating the distributor cap. In Wilkie, an electrical resistance heater is positioned on the inside of the distributor cap and connected to the ignition circuit of an automobile. The heating element is energized when the ignition switch is on and when a thermal-responsive switch senses that the temperature within the distributor is less than a predetermined value. When the distributor has been sufficiently warmed by the engine, the thermal-responsive switch deactivates the heater. In a similar manner, Guth et al. directly heats the interior of the distributor cap. This is accomplished either by providing a heating element within the cap or by transporting externally heated air to the interior region of the cap. A difficulty with each of these arrangements is a failure to recognize, and take provisions to counteract, the problem of moisture forming as the cap cools from the elevated temperature imparted to an engine.

The patents to Arthur, Mallory, and Voigt commonly rely upon a flow of air through the distributor. In Arthur, a flow of air generated by the automobile generator is either directly passed through the distributor cap or used as a means for causing a flow of air through the distributor cap. Since the passageway through the distributor cap remains continuously open to atmosphere, moisture-laden air may be freely drawn into the interior of the distributor as the cap cools from its operating temperature. In Mallory, gases created within the distributor are exhausted and replenished with fresh air drawn through an inlet which remains open to atmosphere. Since no provision is made for closing the air inlet into the distributor housing, moisture-laden air may freely be drawn into the interior of the distributor and condensed. In Voigt, a dehydrating vessel containing a desiccant is secured adjacent the exhaust manifold and provided with a duct that communicates with the interior of a distributor. Another duct connects the interior of the distributor to the intake manifold of the engine. When the temperature of the engine reaches a predetermined value, a thermal-responsive valve opens to permit a flow of air into the dehydrating vessel, downwardly through the desiccant, through the duct into the interior of the distributor, and on into the intake manifold of the engine. In this manner, a dehydrated flow of air passes through the distributor after the engine has reached a predetermined temperature. When the engine ceases operation, the valve closes and moist air contained within the distributor is absorbed by the desiccant. A difficulty with this arrangement is the reliance upon a desiccant to remove moisture from the air prior to its introduction into the interior of the distributor. Under conditions of high humidity, such as those present with marine use, a desiccant would tend to become saturated at such a rate that it would be difficult, if at all possible, to effectively dry the same. As well, when so saturated, a desiccant would tend to disintegrate and, in the arrangement of Voigt, be drawn into the distributor. The introduction of the intake manifold vacuum into the distributor is another undesirable feature of Voigt's dehumidifier. Vacuum applied to the interior of a distributor is in turn applied via the distributor shaft to the engine. Accordingly, the applied vacuum can flood the interior of the distributor with oil withdrawn from the engine. This problem would be particularly prevalent in Voigt's arrangement during the early periods of operation when the thermal-responsive valve has not yet opened to permit a flow of air into the dehydrating vessel and distributor. After the valve opens, there is a flow of air through the dehydrating vessel and distributor and on into the engine by way of the intake manifold. Since Voigt discloses no means for controlling this intake of additional air, it will be appreciated that a lean condition will exist in at least one of the cylinders of the engine. The number of cylinders affected, of course, will depend upon the location on the intake manifold of the connection with the duct leading to the distributor. For a V-8 engine, it is likely that at least two of the cylinders will be subjected to a leaner condition than the remainder of the cylinders. As a result of this condition, the temperature of the affected cylinders will be undesirably raised, producing damage to the valves thereof. As well, it is likely that these cylinders will intermittently fail to fire.

Unregulated manifold vacuum is also applied to the interior of the distributor cap described in Tibbs. More particularly, this vacuum is applied to a chamber which contains the electrical contacts and rotor. While an effort is made to seal this chamber from the rest of the distributor interior, it must be recognized that there remains a risk that either the seals would fail or the manifold vacuum would be sufficient to suck engine oil into the distributor, in the manner discussed above in connection with the Voigt dehumidifier. A potentially more serious difficulty is Tibbs's attention only to the secondary contacts of the distributor. No measures are taken to protect or seal the primary ignition or metal components contained within the lower portion of the distributor. Accordingly, the problems of moisture persist for these components.

The present invention provides an arrangement that overcomes the disadvantages of the developments described above. In particular, an important aspect of the invention is the provision of a system that withdraws humid air from the distributor during the critical engine cool-down period and, thus, prevents the condensation of moisture within the distributor and upon the electrical and mechanical components contained therein. A further aspect of the invention is the utilization of the low pressure created by a flow of air into an engine air intake, such as a spark arrester or air cleaner, to selectively open a sealed distributor system in order to evacuate moisture and distributor gases therefrom.

SUMMARY OF THE INVENTION

In accordance with the invention, there is provided a system for removing moisture from the distributor of a spark-ignition engine. The system includes a preferably cylindrically shaped moisture guard body which is mounted upon the engine to be heated thereby. The moisture guard body has an internal chamber that is connected in fluid communication with the interior of the distributor. As the engine cools after a period of operation, the moisture guard body retains heat so as to collect moisture from within the distributor. When the engine again assumes operation, the moisture collected within the internal chamber of the moisture guard body is exhausted through a one-way fluid path provided by a selectively operable valve. In preferred form, the valve is a check valve that is interposed in a conduit, which is connected at one end to communicate with the internal chamber of the moisture guard body and is connected at the other end to communicate with the flow of air into the engine air intake. This latter connection is preferably made by connecting the conduit to the engine air cleaner or spark arrester, in the case of a marine engine. All of the conventional vents on the distributor body and cap are sealed so that the valve, in its normally closed position, maintains the communicating interiors of the distributor, the moisture guard body, and the connecting passageways in a sealed state. This sealed condition is maintained at all times during the periods when the engine is not operating and, also, during those periods when the engine is operating below a predetermined speed. When the engine speed increases above this predetermined level, the flow of air into the air intake increases to a rate such that an area of low pressure exists within the air cleaner or spark arrester. This low pressure is also applied to the check valve, creating a slight differential pressure that is sufficient to open the valve. When the valve so opens, a path is provided for evacuating moisture collected within the moisture guard body and to remove, as well, the gases that are now being produced within the distributor. Upon the engine slowdown and final shutdown, the check valve closes, returning the moisture guard body and distributor to their sealed state.

As noted above, it is during the period of engine cool-down that moisture condenses inside of a conventional distributor as cool moist air is drawn into the distributor via the vents that are provided for releasing gases. Since with the present invention these distributor vents are sealed and, additionally, the interconnected interiors of the distributor and the moisture guard body are sealed by closure of the valve, the avenues for ingress of moist air are substantially blocked. Since it is not practical from a maintenance or commercial perspective to completely seal the distributor, particularly the connection of the cap to the body, some paths remain for the introduction of moist air into the interior of the distributor. It is this moist air that is drawn away from the distributor and collected in the moisture guard body. In accordance with an aspect of the invention, this is accomplished by constructing the moisture guard body so that it retains the heat imparted to it by the engine and cools at a rate that is slower than the rate of cooling of the distributor cap. These differences in cooling rates set up a temperature differential between the air contained within the interior of the distributor and that contained within the internal chamber of the moisture guard body. Consequently, any moisture within the distributor is withdrawn by convection into the moisture guard body and connecting passageways where it condenses and settles until withdrawn during the next operation of the engine.

According to a further aspect of the invention, provision is made to ensure that moisture is collected within the moisture guard body upon cold start of an engine. This is particularly desirable under the conditions of extreme moisture such as those encountered with a marine engine. This prevention of cold start moisture problems is effected by raising the temperature of the air within the internal chamber of the moisture guard body as soon as the engine is started. In the preferred arrangement, this heating effect is provided by an electrical heating element positioned within the internal chamber of the moisture guard body and connected with the ignition coil of the engine. When the engine is started, these elements rapidly heat the air within the moisture guard body, drawing any moisture humidity that may be present in the distributor into the internal chamber.

BRIEF DESCRIPTION OF THE DRAWINGS

The invention can best be understood by the following portion of the specification taken in conjunction with the accompanying drawings in which.

DETAILED DESCRIPTION OF THE INVENTION

Figure 1:
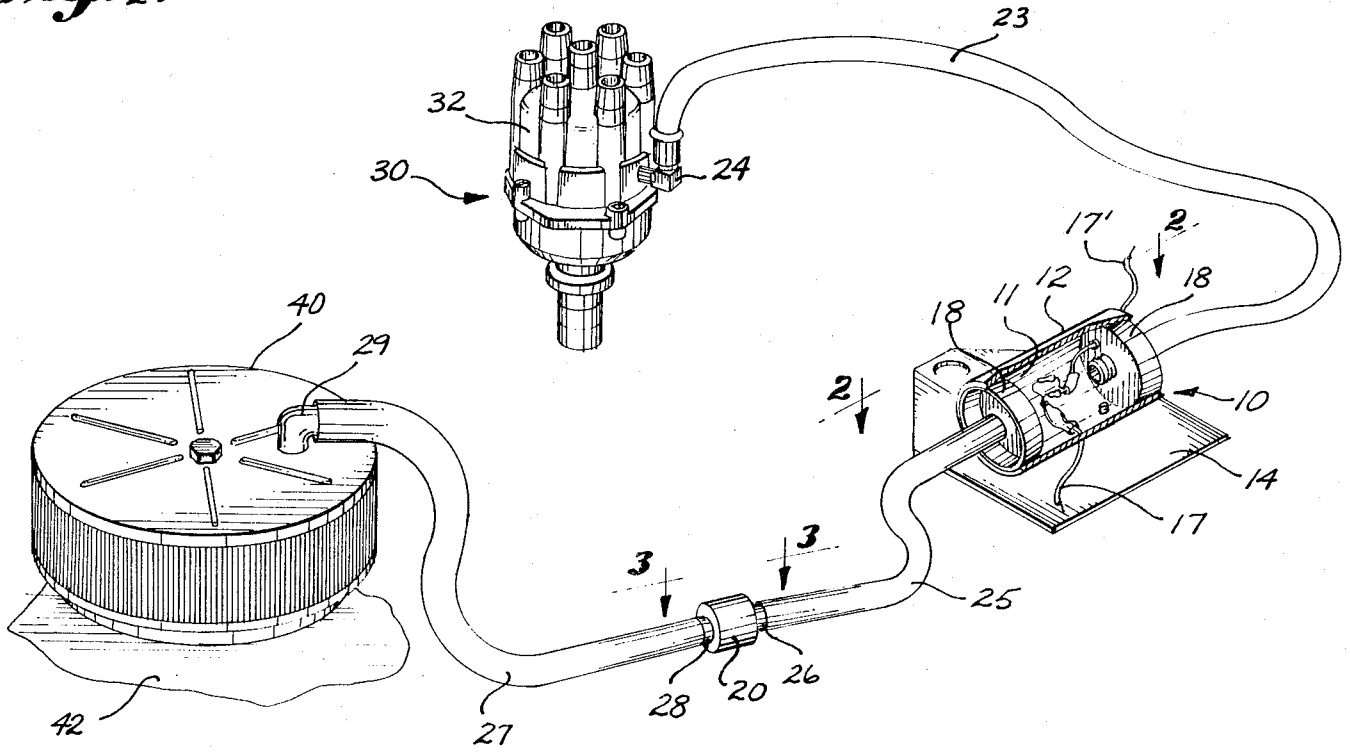
FIG. 1 is a perspective view, partially in section, showing a moisture removal system according to the invention and its installed connections to a distributor and spark arrester of a marine engine.

Referring to FIG. 1, the moisture removal system includes a moisture guard body 10 and a check valve 20 that are connected together in fluid communication between the distributor 30 and the flame arrester, or spark arrester 40 of a spark-ignition engine of the type employed in marine applications. For sake of clarity, details of the engine, including further particulars for the distributor 30 and carburetor 42 upon which the flame arrester is mounted, have been omitted from FIG. 1. These details will, of course, be apparent to those knowledgeable in this art. It is to be understood that the invention is readily adapted for use with a wide variety of spark-ignition engines, including those used for automotive and other nonmarine purposes. Within this range of engines, variations will exist in the construction and arrangement of the distributors and air intake devices. For example, in automotive applications, air is introduced into the carburetor through an air cleaner assembly rather than through a flame arrester as illustrated in FIG. 1. As will become more apparent from the discussion hereinafter, precise arrangement of the air cleaner or flame arrester is not critical to the operation of the invention. It is only important that the check valve 20 be connected to the air intake means through which air for combustion is introduced into the engine.

Figure 2:
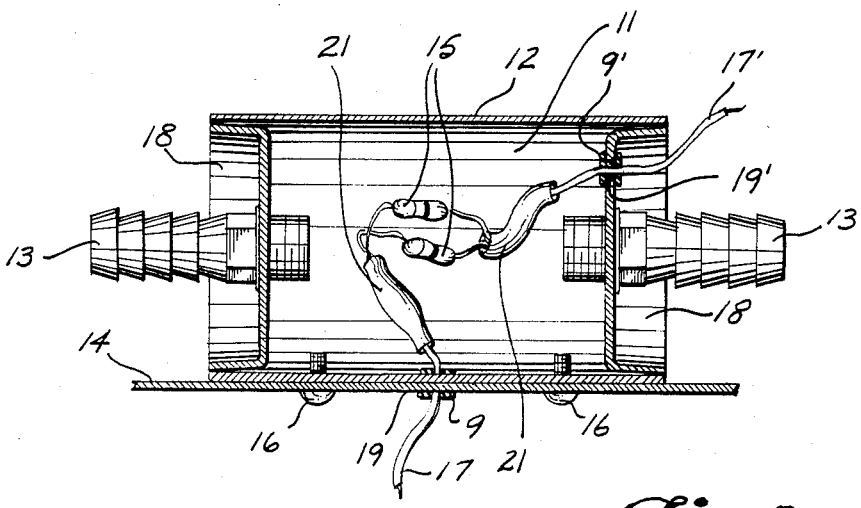
FIG. 2 is an enlarged side sectional view of the moisture guard body taken along line 2—2 of FIG. 1.

With reference to FIGS. 1 and 2, the moisture guard body 10 has a hollow cylindrical shell 12, which is secured to a base 14 by a pair of threaded fasteners 16. The fasteners 16 pass through a hole provided in the base 14 and mate with internal threads provided in apertures through the shell 12. A plug 18 is inserted into each of the open ends of the shell 12 to provide an enclosed, internal chamber 11 within the moisture guard body. The outside edges of the plugs 18 are beveled so that the plugs are firmly held in place by press fit engagement with the adjoining interior surfaces of the shell 12. This beveled press fit plug arrangement is preferred over a more permanent arrangement, such as permanently secured end caps, since it permits easy access to the internal chamber 11 for maintenance purposes.

To provide fluid communication with the internal chamber 11, a straight pipe hose barb 13 is mounted upon each of the plugs 18. The two fittings 13 are conventional brass hose barbs having threaded ends that are received into internally threaded holes provided in the plugs 18.

An electrical heating element, comprising a pair of half-watt ceramic resistors 15 connected in parallel is contained within the internal chamber 11. The leads to the resistors 15 are connected to a pair of wires 17 and 17', which pass outward through a hole 19 in the shell 12 and a hole 19' in one of the plugs 18. A seal is provided between the holes 19 and 19' and the wires 17 and 17' by snap-in rubber grommets 9 and 9', respectively. To provide protection against moisture, the connections between the leads of the resistors 15 and the wires 17 are sealed with sections of shrink tube 21. The purpose of the heating element is to rapidly warm the air within the internal chamber 11 upon startup of a cold engine. To provide this function, one of the wires 17 is connected to the positive terminal on the engine ignition coil (not shown) while the other wire 17 is connected to a grounding point of the engine or vehicle.

As discussed above, the moisture guard body functions to draw moist air from within the interior of the distributor during the critical moisture-forming period of engine cool-down. To perform this important function, the inventive moisture guard body is constructed of a material that will maintain the air within the internal cavity 11 in a heated, gradually cooled state while the air within the distributor 30 cools more rapidly. The cap 32 of the distributor 30 is typically made of a molded plastic material. During operation of the engine, the distributor cap is heated by convection and conduction from the engine. When the engine ceases operation, the plastic distributor cap cools to the temperature of the ambient air. By constructing the shell 12 of brass, the desired retention of heat by the air within the internal chamber 11 is achieved, since brass cools more slowly than the plastic distributor cap. To obtain the necessary heating of the brass shell, the moisture guard body is operationally mounted so as to also be heated by the engine. This is most conveniently accomplished by mounting the moisture guard body directly upon the engine. To this end, the base 14 includes a hole 22 through which a bolt may be passed and screwed into one of the threaded recesses that are usually available on the exterior of the engine block. It will be recognized that the positioning of the moisture guard body so as to be heated by the engine may occur at any of a number of arrangements. As well, a variety of fastening techniques can be utilized. In the preferred arrangement, where the moisture guard body is mounted upon the engine block, the base 14 advantageously is made of a metallic material, such as aluminum, which will further the aim of providing convective heat from the engine. Consistent with this aim, the plugs 18 are also of metallic construction. These plugs could also be of brass, but are preferred to be made of steel for reasons of economy. To resist corrosion, it is preferred that such a steel plug be plated with cadmium.

Fluid communication between the internal chamber 11 and the interior of the distributor is provided through a hose 23, which is connected at one end to one of the straight hose barb fittings 13 and at the other end to a right-angle hose barb fitting 24 mounted on the distributor cap 32. The hose barb fitting 24 is a conventional brass hose barb and is easily mounted to the distributor cap 32 by first drilling, and then tapping a threaded opening.

Figure 3:
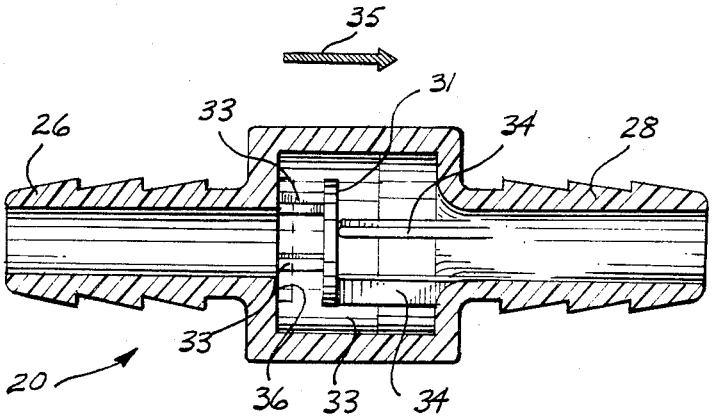
FIG. 3 is an enlarged side sectional view of the check valve taken along line 3—3 of FIG. 1; and, FIG. 4 is an enlarged perspective view, partially in section, of the check valve, with the check shown in phantom lines.

A hose 25 is connected at one end to the other hose barb fitting 13 and at the other end to the barbed inlet 26 of the check valve 20 (see FIGS. 1 and 3). A third hose 27 is connected at one end to the barbed outlet 28 of the check valve and at the other end to another right-angle hose barb fitting 29, which is connected to the top of the flame arrester 40. The hose barb fitting 29 is also of conventional brass design and is received into a threaded hole in the top of the flame arrester 40. The hoses 23, 25 and 27 are preferably constructed of a clear, flexible plastic material, such as polyvinyl chloride. Such construction provides good resistance to temperature and oil and gas and, because of its transparency, enables a visual check to be made of the moisture-collecting operation of the system. For example, moisture remaining on the inside surfaces of the hoses 23 and 25 upon cold startup would indicate that the two resistors 15 are not operating.

Figure 4:
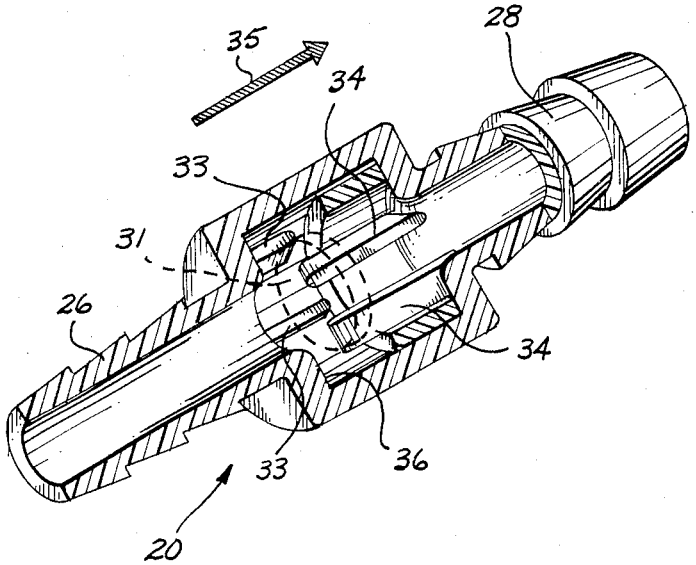

The check valve 20 responds to a lower than ambient pressure created by a flow of air through the flame arrester 40 to provide a path through hose 27 and the fitting 29 for evacuating the space defined by the interior of the distributor 30, the hose 23, the internal chamber 11, and the hose 25. This operation is best understood with reference to FIGS. 3 and 4. The valve contains a disc-shaped self-seating check 31 which moves longitudinally along a path defined by a first set of ribs 33 that are positioned axially about the open interior of the valve. In the valve open position illustrated in FIG. 3, the check 31 has moved into engagement with the ends of a second set of ribs 34. The ribs 34 and 33 are positioned in offset relation relative to one another so that, in the open position of FIG. 3, a labyrinth-like flow path is provided in the direction of the arrow labeled 35 around and through the ribs 33 and 34 and out through the bore in the barbed outlet 28. When the engine speed falls below a predetermined rate, the flow of air through the flame arrester 40 reaches a point at which the low pressure generated thereby is insufficient to hold the check 31 in the valve open position. Consequently, the check 31 reciprocates in the direction of the inlet barb 26 and into engagement with an annular ledge 36. This action seals the space defined above which extends from the inlet 26 into the interior of the distributor 30. It is to be noted that only a small pressure differential is required for moving the check 31 from the closed to the opened position. It is also important to note that, when the check is so opened, there is not a strong suction applied to the system to remove collected moisture and distributor gases. Instead, the opening of the valve 21 by the flow of air into the spark arrester 40 is for the purpose of providing a path through which moisture and distributor gases are removed by convection. The invention, thus, avoids the problem of sucking engine oil into the distributor that is prevalent in the earlier proposals which apply manifold vacuum to the interior of the distributor.

The check valve 20 just described is preferably a plastic backflow preventer of the type commonly employed to prevent a reverse flow of water from an unpressurized, intermittently pumped line. Such a valve responds well to a slight differential pressure and is preferred here. The invention, however, contemplates any other valve means which functions to selectively seal and open the interior spaces of the moisture guard assembly.

As discussed earlier, to exhaust corrosive gases, conventional distributors are provided with vents on either the cap or body, or on both. For marine usage, regulations do not permit vents in the caps, but only in the body. For automotive distributors, the vents are usually one or more small holes on the bottom or side of the base. For marine distributors, screen vents, often called spark arresters, are utilized. In order for the present system to work effectively, it is necessary to seal all such vents on the distributor cap and body. In this manner, no moist air may be drawn into the interior of the distributor to replace the moisture that is drawn away by the heated moisture guard body. While the vents may be sealed in any suitable manner, it is efficiently and effectively accomplished by filling the vents with strip caulk of the type that is typically employed for sealing body seams in automobiles.

The present invention has been described in relation to its preferred embodiments. One of ordinary skill, after reading the foregoing specification, will be able to effect various changes and substitutions of equivalents without departing from the broad concepts disclosed herein. It is therefore intended that the protection afforded by Letters Patent granted hereon be limited only by the definition contained in the appended claims and equivalents thereof.

The embodiments of the invention in which an exclusive property or privilege is claimed are defined as follows:

1. A system for removing moisture from the distributor of a spark-ignition engine, said distributor including vents and a cap connected to a base, said engine including air intake means for conducting a flow of air therethrough, said system comprising:

a shell having an internal chamber, said shell including an outlet port and an inlet port which communicate with said internal chamber;

means connected to the cap of said distributor and to the inlet port of said shell for providing fluid communication between the interior of said distributor and said internal chamber;

a valve having an inlet and an outlet, said inlet being connected in fluid communication with the outlet port of said shell, said valve being selectively operable to permit a one-way fluid flow from its inlet to its outlet;

conduit means for connecting the outlet of said valve in fluid communication with said intake means; and means for sealing the vents of said distributor.

2. The system of claim 1, wherein said shell comprises a cylinder having open ends, said cylinder having a plug secured to each of its open ends, said outlet port being provided on one of said plugs, said inlet port being provided on the other of said plugs.

3. The system of claim 2, wherein said plugs are secured by pressure fit engagement with the open ends of said cylinder.

4. The system of claim 3, wherein said cylinder is of brass.

5. The system of claim 3, further including an electrical heating element mounted within said cylinder and connected with the ignition of said engine.

6. A system for removing moisture from the distributor of a spark-ignition engine, said distributor including vents, said engine including air intake means for conducting a flow of air therethrough, said system comprising:

a moisture guard body mounted upon said engine to be heated thereby, said moisture guard body having an internal chamber in fluid communication with the interior of said distributor, said internal chamber collecting moisture from the interior of said distributor as said engine cools from an operating temperature;

valve means responsive to a flow of air through said intake means for selectively providing a one-way fluid path for exhausting moisture collected in the internal chamber of said moisture guard body; and means for sealing the vents of said distributor.

7. The system of claim 6, wherein said distributor includes a distributor cap which is heated by the engine during operation thereof and wherein said distributor cap and said moisture guard body are each cooled when said engine ceases operation, and wherein the cooling of said moisture guard body occurs at a slower rate than the cooling of said distributor cap.

8. The system of claim 7, wherein said valve means comprises a check valve connected in fluid communication with said intake means and the internal chamber of said moisture guard body.

9. The system of claim 8, wherein said engine includes an air cleaner and wherein said check valve is connected to said air cleaner.

10. The system of claim 9, further including an electrical heating element mounted within the internal chamber of said moisture guard body and connected with the ignition of said engine.

11. A device for attachment to the distributor and to the air intake of a spark-ignition engine, said device comprising:

a shell having an internal chamber, said shell including an outlet port and an inlet port that communicate with said internal chamber;

a first conduit having a first end connected to said inlet port and a second end adapted for connection to said distributor;

a check valve having an inlet and an outlet, said valve being operable to permit a one-way fluid flow from its inlet to its outlet;

a second conduit having a first end connected to the outlet port of said shell and a second end connected to the inlet of said valve; and a third conduit having a first end connected to the outlet of said valve and a second end adapted for connection to said air intake.

12. The device of claim 11, wherein said shell comprises a cylinder having open ends, said cylinder having a plug secured to each of its open ends, said outlet port being provided on one of said plugs, said inlet port being provided on the other of said plugs.

13. The device of claim 12, wherein said plugs are secured by pressure fit engagement with the open ends of said cylinder.

14. The device of claim 13, further including:

an electrical heating element mounted within the internal chamber of said cylinder; and means for connecting said heating element with a source of electricity.

* * * * *